United States Patent [19]

Kawai et al.

[11] 4,168,681

[45] Sep. 25, 1979

[54] BUTTERFLY VALVE OPENING DEGREE SETTING DEVICE

[75] Inventors: Noriaki Kawai, Okazaki; Heisuke Yamamoto, Toyota, both of Japan

[73] Assignee: Toyota Jidosha Kogyo Kabushiki Kaisha, Aichi, Japan

[21] Appl. No.: 799,917

[22] Filed: May 24, 1977

[30] Foreign Application Priority Data

Mar. 25, 1977 [JP] Japan ..... 52-32159

[51] Int. Cl.[2] ..... F02M 1/14; F02M 19/12

[52] U.S. Cl. ..... 123/103 R; 123/97 R; 123/198 DB; 123/DIG. 11; 261/DIG. 18

[58] Field of Search ..... 123/DIG. 11, 97 B, 103 R, 123/103 B, 103 E, 124 R, 124 A, 198 DB; 261/DIG. 18, DIG. 19, 65

[56] References Cited

U.S. PATENT DOCUMENTS

| | | | |
|---|---|---|---|
| 3,721,222 | 3/1973 | Shioya et al. | 123/103 R |
| 3,752,141 | 8/1973 | Charron et al. | 123/103 R |
| 3,753,427 | 8/1973 | Cedar | 123/103 R |
| 3,760,785 | 9/1973 | Harrison et al. | 123/103 R |
| 3,841,281 | 10/1974 | Mich | 123/97 B |
| 3,996,904 | 12/1976 | Kobuki et al. | 123/97 R |
| 4,051,823 | 10/1977 | Mogi et al. | 123/97 B |
| 4,060,063 | 11/1977 | Hirasawa | 123/97 R |
| 4,095,567 | 6/1978 | Chenet | 123/103 R |

FOREIGN PATENT DOCUMENTS

| | | | |
|---|---|---|---|
| 1955031 | 5/1971 | Fed. Rep. of Germany | 123/97 B |

*Primary Examiner*—Charles J. Myhre
*Assistant Examiner*—Craig R. Feinberg
*Attorney, Agent, or Firm*—Stevens, Davis, Miller & Mosher

[57] ABSTRACT

Disclosed is a butterfly valve opening degree setting device comprising a diaphragm apparatus. The diaphragm apparatus has a diaphragm, a vacuum chamber and a control rod connected to the diaphragm. The control rod is arranged so as to be engageable with the butterfly valve disposed in the duct. The vacuum chamber of the diaphragm apparatus is connected to the vacuum port formed on the inner wall of the duct. The butterfly valve is held open at a position wherein the peripheral edge of the butterfly valve faces the vacuum port.

10 Claims, 5 Drawing Figures

BUTTERFLY VALVE OPENING DEGREE SETTING DEVICE

DESCRIPTION OF THE INVENTION

The present invention relates to a butterfly valve opening degree setting device and particularly relates to a throttle valve or a choke valve opening degree setting device of a carburetor of an internal combustion engine.

In a conventional engine, the idling position of the throttle valve of a carburetor is adjusted by using an idling position adjust screw or by using a complicated link mechanism. However, if various complicated devices are arranged around the carburetor for purifying the exhaust gas as in a prevailing engine, it is difficult to find a space to be used for attaching a complicated link mechanism for adjusting a throttle valve opening degree. In addition, since the accuracy of the opening degree of the throttle valve has a great influence on the production of harmful components in the exhaust gas, it is necessary to further improve the adjusting accuracy of the opening degree of the throttle valve. In a conventional throttle valve opening degree setting device, however, the adjusting accuracy of the opening degree of the throttle valve is about $\pm 1°$ at the utmost. In addition, if a complicated link mechanism is used for adjusting the opening degree of the throttle valve, it is difficult to hold the throttle valve at a desired opening degree due to the irregularity in the accuracy of the size of the link mechanism. Furthermore, if such a link mechanism is used for a long time, the throttle valve cannot be held at a regular opening degree due to wear of the link mechanism. This results in a problem that the amount of harmful components in the exhaust gas is increased.

An object of the present invention is to provide a butterfly valve opening degree setting device of a simple construction, which is capable of accurately holding a butterfly valve such as a throttle valve and a choke valve at a predetermined opening degree.

According to the present invention, there is provided a butterfly valve opening degree setting device of a flow rate control apparatus having a duct which has an inner wall defining a fluid passage, said device comprising: a rotatable butterfly valve disposed in said fluid passage and having a peripheral edge; a port formed on the inner wall of said fluid passage and arranged to face the peripheral edge of said butterfly valve when said butterfly valve is positioned at a predetermined opening degree; vacuum operated control means connected to said port via a vacuum conduit for holding said butterfly valve open at said predetermined opening degree, and; a resilient member for urging said butterfly valve towards its closed position.

The present invention may be more fully understood from the description set forth below of preferred embodiments of the invention, together with the accompanying drawings.

DESCRIPTION OF PREFERRED EMBODIMENTS

Figure 1:
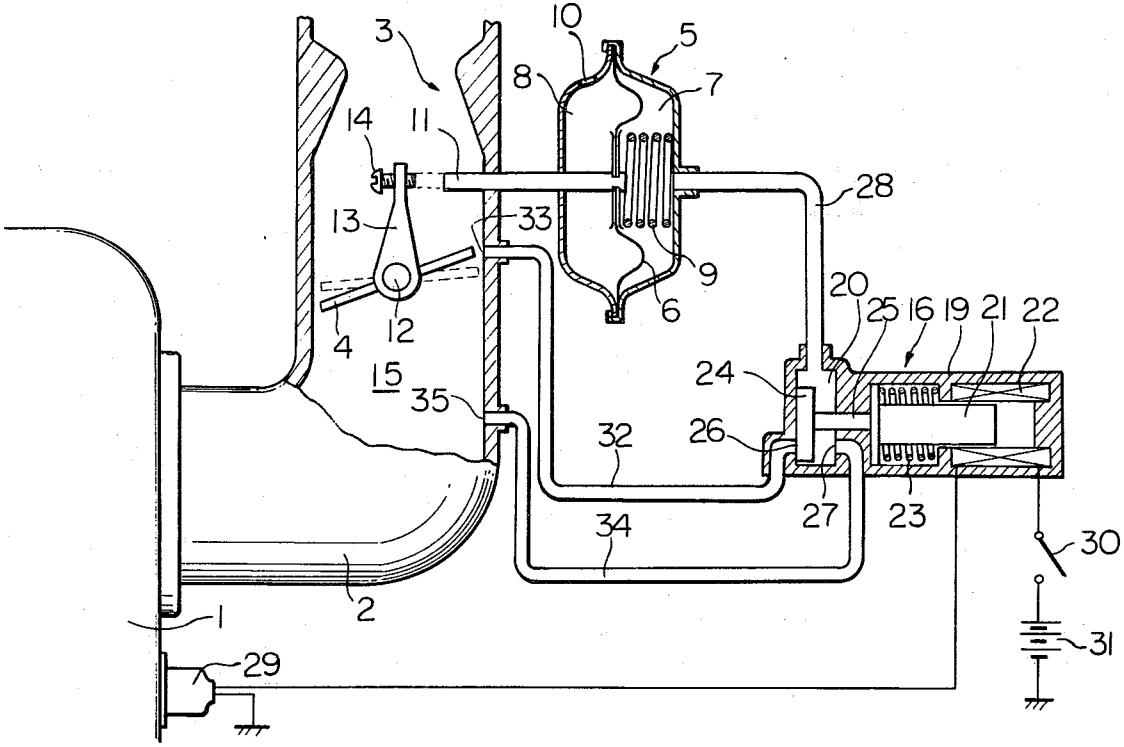
FIG. 1 is a schematic view of an embodiment of a butterfly valve opening setting device according to the present invention.

Referring to FIG. 1, 1 designates an engine body, 2 an intake manifold, 3 a carburetor, 4 a throttle valve, and 5 a diaphragm apparatus. This diagragm apparatus has in its housing a vacuum, chamber 7 and an atmospheric pressure chamber 8 which are separated by a diaphragm 6. A compression spring 9 is disposed in the vaccum chamber 7, and the diaphragm 6 is always biased towards the left in FIG. 1 due to the spring force of the compression spring 9. The atmospheric pressure chamber 8 is connected to the atmosphere via an opening 10. In addition, a control rod 11 passing through the atmospheric pressure chamber 8 and extending outwardly from the housing of the diaphragm apparatus 5 is rigidly fixed onto the diaphragm 6. An arm 13 is fixed onto a throttle shaft 12 of the throttle valve 4 so as to rotate together with the throttle valve 4. An adjust screw 14 is screwed into the upper end of the arm 13, and the control rod 11 is so arranged that its tip faces the adjust screw 14. The throttle valve 4 is always urged in the clockwise direction in FIG. 1 due to the spring force of a spring (not shown).

The electromagnetic switching valve generally designated by reference numeral 16 comprises a housing 19, a valve chamber 20 formed in the housing 19, a movable plunger 21 movable in the housing 19 and a solenoid 22 serving to attract the movable plunger 21; a compression spring 23 always biasing the movable plunger 21 towards the left in FIG. 1 and a valve head 24 disposed in the valve chamber 20 and connected to the movable plunger 21 via a valve stem 25. A pair of valve ports 26 and 27 arranged to face the valve head 24 open into the valve chamber 20, and this valve chamber 20 is connected to the vacuum chamber 7 of the diaphragm apparatus 5 via conduit 28. The solenoid 22 of the electromagnetic valve 16 is connected to a temperature detecting switch 29 detecting the temperature of the coolant of the engine on one hand, to a power source 31 via an ignition switch 30. The temperature detecting switch 29 is turned to the ON condition when the temperature of the coolant of the engine is lowered below a predetermined level, for example 40° C., while the temperature detecting switch 29 in turned to the OFF condition when the temperature of the coolant of the engine is elevated beyond the above-mentioned predetermined level. Consequently, the solenoid 22 remains energized until the time the temperature of the coolant of the engine attains the predetermined level after the engine is started by operating the ignition switch 30 and, as a result, the movable plunger 21 moves towards the right in FIG. 1 due to the attracting force of the solenoid 22. As a result of this, the valve head 24 opens the valve port 26 and closes the valve port 27. Contrary to this, when the temperature of the coolant of the engine is elevated beyond the predetermined level, the solenoid 22 is de-energized and, as a result, the valve head 24 is returned to the position shown in FIG. 1. At this time, the valve head 24 closes the valve port 26 and opens the valve port 27.

The valve port 26 is connected to a vacuum port 33 via a vacuum conduit 32, while the valve port 27 is connected via a vacuum conduit 34 to a vacuum port 35 opening into the intake passage 15 downstream of the throttle valve 4. The vacuum port 33 is arranged so as to open into the intake passage 15 upstream of the throttle valve 4 when the opening degree of the throttle valve 4 is slightly larger than an idling opening degree shown by the broken line in FIG. 1, and open into the intake passage 15 downstream of the throttle valve 4 when the throttle valve 4 is opened to a greater extent.

As is mentioned above, when the temperature of the coolant of the engine is higher than the predetermined level, the valve head 24 of the electromagnetic switching valve 16, is in the position shown in FIG. 1. Consequently, at this time, the vacuum chamber 7 of the diaphragm apparatus 5 is connected to the inside of the intake manifold 2 via the conduits 28 and 34 and, thus, a vacuum is always produced in the vacuum chamber 7. As a result of this, the diaphragm 6 moves towards the right in FIG. 1. against the spring force of the compression spring 9 and, thus, the control rod 11 is retracted to a position shown by the solid line in FIG. 1. Consequently, in this case, the adjust screw 14 of the arm 13 cannot abut against the tip of the control rod 11.

When the temperature of the coolant of the engine is lower than the predetermined level, the solenoid 22 is energized and, as a result, the vacuum chamber 7 of the diaphragm apparatus 5 is connected to the vacuum port 33 via the conduits 28 and 32. At this time, if the vacuum port 33 opens into the intake passage 15 upstream of the throttle valve 4, since the pressure in the vacuum chamber 7 becomes equal to approximately atmospheric pressure, the diaphragm 6 moves towards the left in FIG. 1 due to the spring force of the compression spring 9 and, as a result, the control rod 11 projects as is shown by the broken line in FIG. 1. At this time, the tip of the control rod 11 comes into contact with the adjust screw 14 of the arm 13, thus causing the rotation of the throttle valve 4 in the counter-clockwise direction in FIG. 1. As a result of this, the vacuum port 33 opens into the intake passage 15 downstream of the throttle valve 4 and, thus, a vacuum is produced in the vacuum chamber 7. Therefore, the control rod 11 moves towards the right in FIG. 1. This results in causing the rotation of the throttle valve 4 in the clockwise direction, whereby the pressure in the vacuum chamber 7 again becomes equal to approximately atmospheric pressure. As is mentioned above, when the throttle valve 4 rotates in the clockwise direction or in the counterclockwise direction so as to move away from a position shown by the solid line in FIG. 1, since the force returning the throttle valve 4 to the position shown by the solid line in FIG. 1 acts upon the throttle valve 4, the throttle valve 4 remains stopped at a position wherein the peripheral edge of the throttle valve 4 substantially faces the vacuum port 33, as is shown by the solid line in FIG. 1. Consequently, as will understood, since the opening degree of the throttle valve 4 is determined only by the location of the vacuum port 33, the throttle valve 4 is always held open at a predetermined regular position. According to experiments conducted by the inventor's assignee the adjusting accuracy of the opening degree of the throttle valve 4, which can be obtained according to the present invention, is less than ±30'.

The embodiment shown in FIG. 1 shows the case wherein an idling opening degree of the throttle valve 4, at the time before completion of the warm-up of the engine, is held at a predetermined degree which is larger than an idling, opening degree at the time after completion of the warm-up of the engine. However, as is hereinafter mentioned, the present invention can be applied to various devices.

Figure 2:
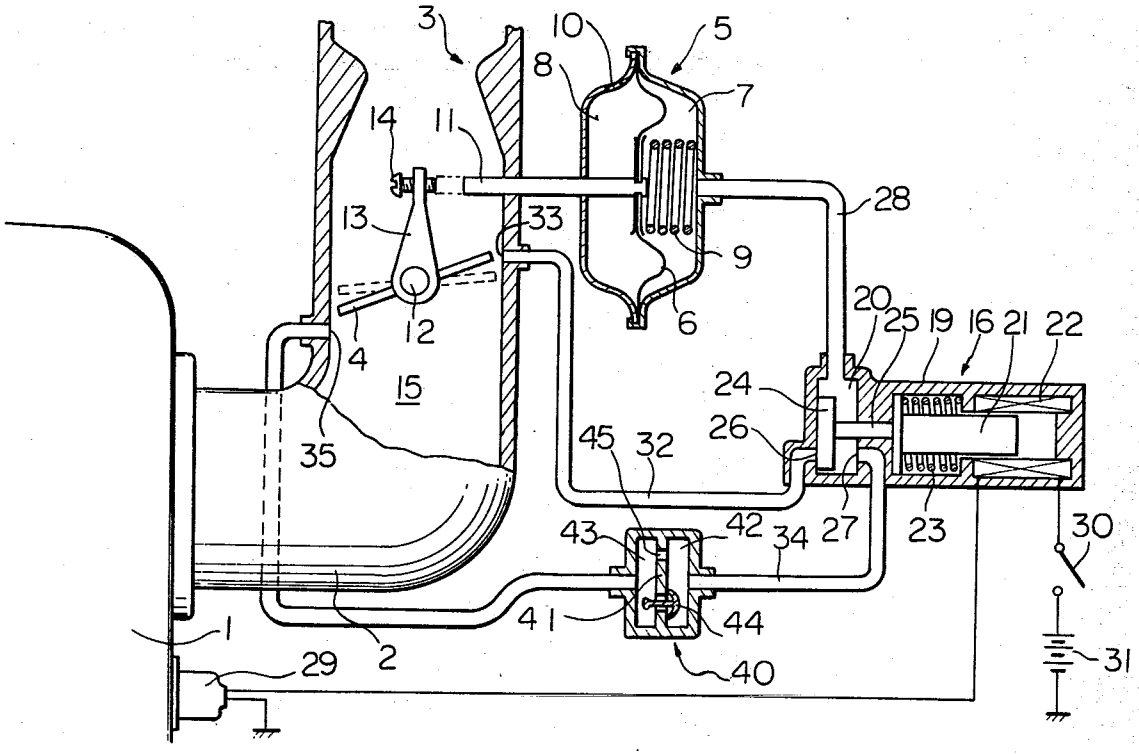
FIG. 2 is a schematic view of another embodiment according to the present invention.

FIG. 2 shows another embodiment according to the present invention. In this embodiment and the embodiments which are hereinafter described, similar components are indicated with the same reference numerals as used in FIG. 1. Referring to FIG. 2, a delay valve 40 is disposed in the vacuum conduit 34. This delay valve 40 has in its housing a first chamber 42 and a second chamber 43 which are separated by a partition 41. A check valve 44 permitting the outflow of air from the second chamber 43 to the first chamber 42 is disposed in the partition 41. In addition, a restricted opening 45 is formed on the partition 41. Furthermore, in the embodiment shown in FIG. 2, the vacuum port 35 is arranged so as to open into the intake passage 15 upstream of the throttle valve 4 when the throttle valve 4 is opened beyond a predetermined opening degree.

In the embodiment shown in FIG. 2, when the temperature of the coolant of the engine is lower than the predetermined level, the same operation as described with reference to the embodiment shown in FIG. 1 is carried out. Consequently, the description of this operation is omitted here. On the other hand, when the temperature of the coolant of the engine is higher than the predetermined level, the valve head 24 of the electromagnetic switching valve 16 is in the position shown in FIG. 2, as described with reference to FIG. 1, and thus, the vacuum chamber 7 of the diaphragm apparatus 5 is connected to the vacuum port 35 via the conduits 28 and 34. At this time, if the throttle valve 4 is opened to a great extent, the vacuum port 35 opens into the intake passage 15, at a position upstream of the throttle valve 4 and, thus, the pressure in the vacuum chamber 7 becomes equal to approximately atmospheric pressure. As a result of this, the diaphragm 6 moves towards the left in FIG. 2 and, thus, the control rod 11 projects as is shown by the broken line in FIG. 2. After this, when the throttle valve 4 is rapidly closed as in the case wherein a vehicle is decelerated, the vacuum leve in the intake manifold 2 is greatly increased. Consequently, a large vacuum is produced in the vacuum port 35. However, since the restricted opening 45 is disposed in the conduit 34, the pressure in the vacuum chamber 7 is maintained at approximately atmospheric pressure for a while. As a result of this, the return motion of the throttle valve 4 is prevented by the control rod 11, whereby the throttle valve 4 is held open at a position shown by the solid line in FIG. 4. Then, the control rod 11 gradually moves towards the right in FIG. 2 as the vacuum level in the vacuum chamber 7 is gradually increased and, thus, the throttle valve 4 is gradually returned to the idling position shown by the broken line in FIG. 2.

In general, when the throttle valve 4 is rapidly closed, the vacuum level in the intake manifold 2 is greatly increased and, as a result, the liquid fuel stuck to the inner wall of the intake manifold 2 is vaporized. Therefore, the air-fuel mixture fed into the cylinder of the engine becomes excessively rich which results in a misfire occurring. However, by providing the delay valve 40 as mentioned above, when the throttle valve 4 is rapidly closed, the throttle valve 4 is temporarily held open a predetermined opening degree and, then, gradually returned to the idling position. Consequently, even if the throttle valve 4 is rapdily closed, an increase in the vacuum level in the intake manifold 2 is not too great. Therefore, the air-fuel mixture fed into the cylinder of the engine does not become excessively rich, thus preventing the occurrence of a misfire.

Figure 3:
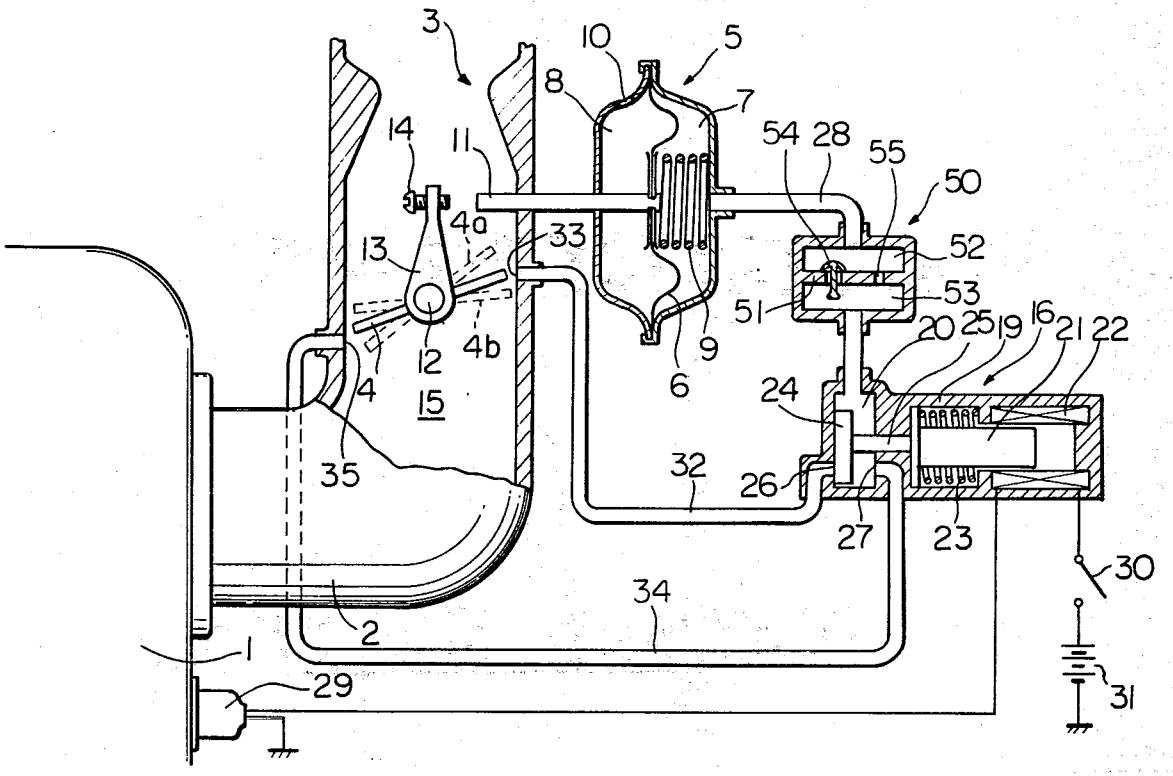
FIG. 3 is a schematic view of a further embodiment according to the present invention.

FIG. 3 shows a further embodiment according to the present invention. In this embodiment, a delay valve 50 is disposed in the conduit 28. This delay valve 50 has in its housing a first chamber 52 and a second chamber 53 which are separated by a partition 51. A check valve 54 permitting the outflow of air from the second chamber 53 to the first chamber 52 is disposed on the partition 51. In addition, a restricted opening 55 is formed in the partition 51.

In the embodiment shown in FIG. 3, when the temperature of the coolant of the engine is higher than the predetermined level, the same operation as described with reference to the embodiment shown in FIG. 2 is carried out. Consequently, the description of this operation is omitted here. Before the engine is started, the pressure in the vacuum chamber 7 is equal to atmospheric pressure. Consequently, at this time, the control rod 11 projects at its most projecting position and, as a result, the throttle valve 4 is held open at an opening degree shown by the broken line 4*a* in FIG. 3, which is larger than the opening degree shown by the solid line in FIG. 3. When the engine is started, since the temperature of the coolant of the engine is relatively low, the solenoid 22 of the electromagnetic switching valve 16 is energized and, as a result the vacuum chamber 7 of the diaphragm apparatus 5 is connected via the conduits 28 and 32 to the vacuum port 33 opening into the intake passage 15 downstream of the throttle valve 4. On the other hand, when the engine is started, a vacuum is produced in the intake manifold 15. However, since the restricted opening 55 is disposed in the conduit 28, the vacuum chamber 7 is maintained at atmospheric pressure for a while. Then, the vacuum level in the vacuum chamber 7 is gradually increased and, accordingly, the control rod 11 moves towards the right in FIG. 3. Then, in the same manner as described with reference to the embodiment shown in FIG. 1, the throttle valve 4 is held open at the opening degree shown by the solid line in FIG. 3, which is larger than the idling opening degree 4*b* in the case wherein the warm-up of the engine has been completed. As is mentioned above, in the embodiment shown in FIG. 3, for a short time after the engine is started, the throttle valve 4 can be held at the opening degree 4*a* which is larger than the opening degree shown by the solid line in FIG. 3 is the case wherein the warm-up of the engine is not completed.

In a vehicle equipped with a cooling system driven by the engine, during the time when the cooling system is operating, it is necessary to increase the number of revolutions of the engine at the time of idling. In such a case, the number of revolutions of the engine at the time of idling can be increased in such a way that, in FIGS. 1 through 3, the electromagnetic switching valve 19 is connected to the power source 31 via the switch of the cooling system (not shown) so that the solenoid 22 is energized when the cooling system is operated, whereby the throttle valve 4 is held open at the opening degree shown by the solid line in FIGS. 1 through 3.

Figure 4:
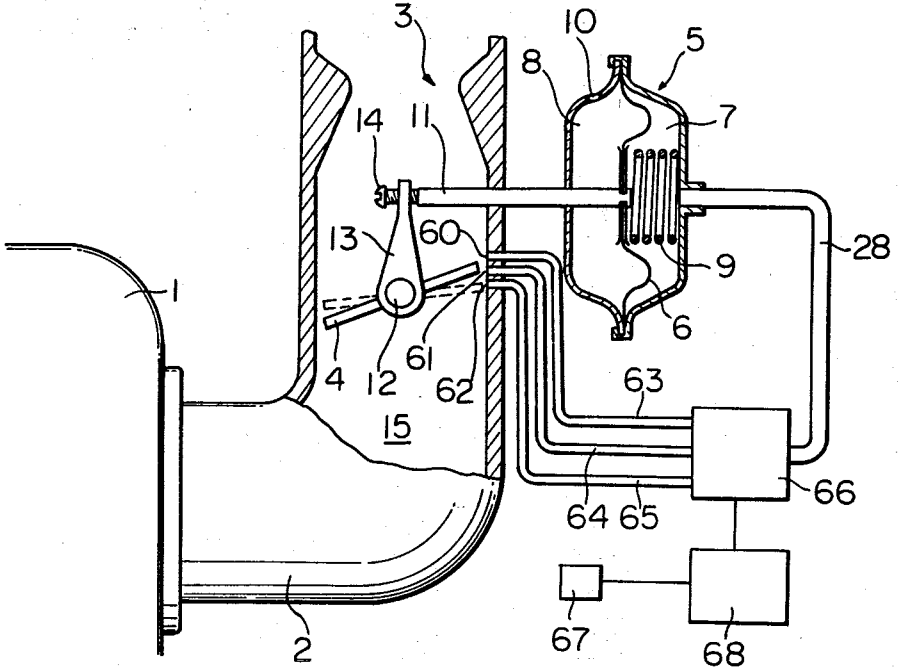
FIG. 4 is a schematic view of a still further embodiment according to the present invention.

FIG. 4 shows a still further embodiment according to the present invention. Referring to FIG. 4, a number of vacuum ports 60, 61 and 62 are provided in the vicinity of the vacuum port 33 shown in FIG. 1. These vacuum ports 60, 61 and 62 are connected to the vacuum chamber 7 via corresponding vacuum conduits 63, 64 and 65, an electromagnetic switching valve 66 and the common vacuum conduit 28. Reference numeral 67 designates a detector for detecting, for example, the temperature of the engine, and reference numeral 68 designates a control circuit for controlling the electromagnetic switching valve 66 on the basis of the output signal of the detector 67. In this embodiment, the switching operation of the electromagnetic switching valve 66 is carried out so that the vacuum chamber 7 is connected to the vacuum port 60 when the temperature of the engine is lower than 0° C.; the vacuum chamber 7 being connected to the vacuum port 61 when the temperature of the engine is in the range of 0° C. through 40° C.; the vacuum chamber 7 being connected to the vacuum port 62 when the temperature of the engine is higher than 40° C. As mentioned with reference to FIG. 1, the throttle valve 4 is held open at a position wherein the peripheral edge of the throttle valve 4 faces a vacuum port connected to the vacuum chamber 7. Consequently, in the embodiment shown in FIG. 4, the idling opening degree of the throttle valve 4 can be increased as the temperature of the engine is lowered.

Figure 5:
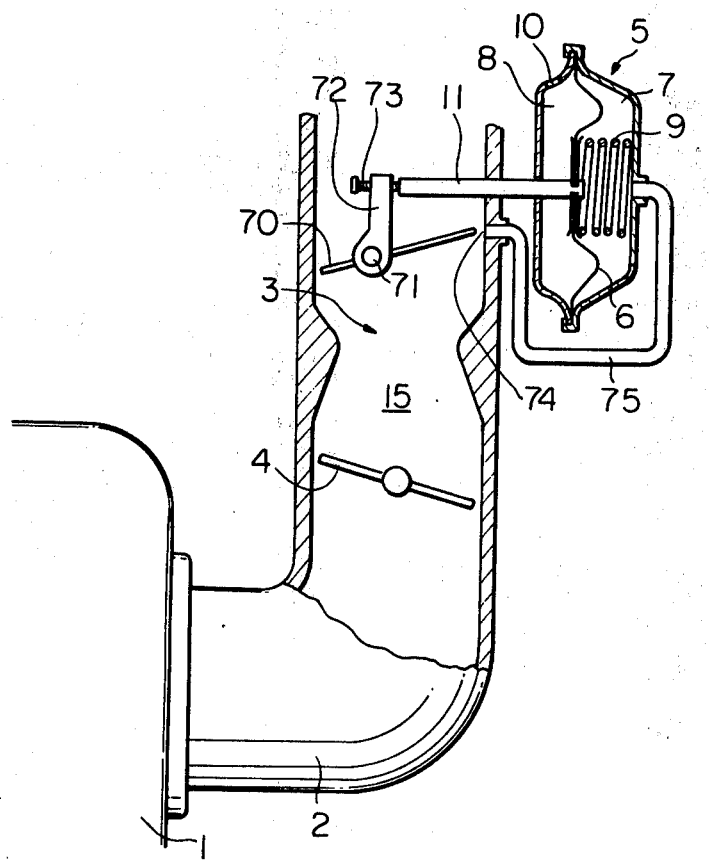
FIG. 5 is a schematic view of a still further embodiment according to the present invention.

FIG. 5 shows the case wherein the present invention is applied to a control mechanism of a choke valve. In FIG. 5, 70 designates a choke valve, 71 a choke shaft, 72 an arm rigidly fixed to the choke shaft 71, 73 an adjust screw mounted on the arm 72 arranged to be engageable with the control rod 11 and 74 a vacuum port connected to the vacuum chamber 7 via a conduit 75. The throttle shaft 71 is connected to an automatic choke valve opening control mechanism (not shown) so that the choke valve 70 is gradually opened as the temperature of the engine is elevated. In this embodiment, in the same manner as described with reference to the embodiment shown in FIG. 1, the choke valve 70 is held open at a position wherein the peripheral edge of the choke valve 70 substantially faces the vacuum port 74. Consequently, the choke valve 70 can be accurately held open at a predetermined regular position.

In the embodiments shown in FIGS. 1 through 3, the temperature of the coolant of the engine is detected by the temperature detecting switch 29. However, instead of detecting the temperature of the coolant of the engine, it is possible to detect another temperature, such as the temperature of the lubricating oil of the engine, the temperature of the exhaust gas, the temperature of the engine body, the temperature in the engine compartment and the temperature of the fuel.

According to the present invention, by using a simple mechanism, a throttle valve and a choke valve are accurately held open at a predetermined regular position. In addition, by providing a delay valve, the occurrence of a misfire is prevented at the time of deceleration. Furthermore, the present invention can be applied to a butterfly valve opening control device disposed in a fluid passage for controlling the flow rate of fluid.

While the invention has been described by reference to specific embodiments chosen for purposes of illustration, it should be apparent that numerous modifications could be made thereto by those skilled in the art without departing from the spirit and scope of the invention.

What is claimed is:

1. A butterfly valve opening degree setting device of an internal combustion engine have a duct which has an inner wall defining a longitudinally extending intake passage, said device comprising:

a butterfly valve rotatable about an axis, disposed in said intake passage and having a peripheral edge;

a port in the inner wall of said intake passage and arranged to face and be longitudinally coextensive with the peripheral edge of said butterfly valve when said butterfly valve is positioned at a predetermined opening degree;

vacuum operated control means connected to said port via a vacuum conduit for holding said butterfly valve open at said predetermined opening degree in which the peripheral edge of the butterfly valve faces and is longitudinally coextensive with the port;

a resilient member for urging said butterfly valve towards its idling position; and switching means in a vacuum passage for connecting said vacuum operated control means with another port opening into said intake passage downstream of the axis of said butterfly valve when the temperature of the engine is higher than a predetermined level to permit said butterfly valve to be returned to its idling position, said switching means comprising an electromagnetic switching valve and a temperature detecting switch detecting the temperature of the engine for energizing said electromagnetic switching valve when the temperature of the engine is lower than a predetermined level.

2. A butterfly valve opening degree setting device of a flow rate control apparatus having a duct which has an inner wall defining a longitudinally extending fluid passage, said device comprising:

a butterfly valve rotatable about an axis, disposed in said fluid passage and having a peripheral edge;

a port in the inner wall of said fluid passage and arranged to face and be longitudinally coextensive with the peripheral edge of said butterfly valve when said buterfly valve is positioned at a predetermined opening degree;

vacuum operated control means connected to said port via a vacuum conduit for holding said butterfly valve open at said predetermined opening degree in which the peripheral edge of the butterfly valve faces and is longitudinally coextensive with the port;

a resilient member for urging said butterfly valve toward a closed position; and switching means in a vacuum passage for connecting said vacuum operated control means with another port opening into said intake passage downstream of the axis of said butterfly valve when the temperature of the engine is higher than a predetermined level to permit said butterfly valve to be returned to its closed position, said switching means comprising an electromagnetic switching valve and a temperature detecting switch detecting the temperature of the engine for energizing said electromagnetic switching valve when the temperature of the engine is lower than a predetermined level.

3. A butterfly valve opening degree setting device of a flow rate control apparatus having a duct which has an inner wall defining a longitudinally extending fluid passage, said device comprising:

a rotatable butterfly valve disposed in said fluid passage and having a peripheral edge;

a port in the inner wall of said fluid passage and arranged to face and be longitudinally coextensive with the peripheral edge of said butterfly valve when said butterfly valve is positioned at a predetermined opening degree;

vacuum operated control means connected to said port via a vacuum conduit for holding said butterfly valve open at said predetermined opening degree in which the peripheral edge of the butterfly valve faces and is longitudinally coextensive with the port;

a resilient member for urging said butterfly valve towards a closed position; and switching means in a vacuum passage for connecting said vacuum operated control means with another port opening into said intake passage downstream of said butterfly valve at all times to permit said butterfly valve to be returned to its closed position, said switching means comprising an electromagnetic switching valve and a temperature detecting switch detecting the temperature of the engine for energizing said electromagnetic switching valve when the temperature of the engine is lower than a predetermined level.

4. A butterfly valve opening degree setting device as claimed in claim 1, wherein said butterfly valve is a throttle valve, a delay valve is disposed in said vacuum passage for temporarily holding said throttle valve at a predetermined opening degree when said throttle valve is rapidly closed and when the temperature of the engine is higher than said predetermined level.

5. A butterfly valve opening degree setting device as claimed in claim 1, wherein said butterfly valve is a throttle valve, a delay valve is disposed in said vacuum passage for temporarily holding said throttle valve at an opening degree which is larger than said predetermined opening degree immediately after the engine is started.

6. A butterfly valve opening degree control device as claimed in claim 3, wherein said vacuum operated control means comprises a housing, a diaphragm disposed in said housing and defining in said housing an atmospheric pressure chamber and a vacuum chamber connected to said port via said vacuum conduit, a control rod connected to said diaphragm and extending through said atmospheric pressure chamber, and a spring member disposed in said vacuum chamber and biasing said diaphragm towards said atmospheric pressure chamber, said control rod being arranged to be engageable with said butterfly valve for holding said butterfly valve open at said predetermined opening degree.

7. A butterfly valve opening degree setting device of an internal combustion engine having a duct which has an inner wall defining a longitudinally extending intake passage, said device comprising:

a rotatable butterfly valve disposed in said intake passage and having a peripheral edge;

a port in the inner wall of said intake passage and arranged to face and be longitudinally coextensive with the peripheral edgeof said butterfly valve when said butterfly valve is positioned at a predetermined opening degree;

vacuum operated control means connected to said port via a vacuum conduit for holding said butterfly valve open at said predetermined opening degree in which the peripheral edge of the butterfly valve faces and is longitudinally coextensive with the port;

a resilient member for urging said butterfly valve towards its idling portion; and switching means in a vacuum passage for connecting said vacuum operated control means with another port opening into said intake passage downstream of said butterfly valve at all times to permit said butterfly valve to be returned to its idling position, said switching means comprising an electromagnetic switching valve and a temperature detecting switch detecting the temperature of the engine for energizing said electromagnetic switching valve when the temperature of the engine is lower than a predetermined level.

8. A butterfly valve opening degree control device as claimed in claim 1, wherein said vacuum operated control means comprises a housing, a movable wall disposed in said housing and defining in said housing an atmospheric pressure chamber and a vacuum chamber connected to said port via said vacuum conduit, a control rod connected to said movable wall and extending through said atmospheric pressure chamber, and a spring member disposed in said vacuum chamber and biasing said movable wall towards said atmospheric pressure chamber, said control rod being arranged to be engageable with said butterfly valve for holding said butterfly valve open at said predetermined opening degree.

9. A butterfly valve opening degree setting device as claimed in claim 8, wherein said movable wall is a diaphragm.

10. A butterfly valve opening degree setting device as claimed in claim 7, wherein said butterfly valve is a throttle valve.

* * * * *